United States Patent [19]

Schweizer et al.

[11] 3,954,277

[45] May 4, 1976

[54] SKI BINDING

[75] Inventors: Gottfried Schweizer; Franz Hrachowitz, both of Vienna, Austria

[73] Assignee: Gertsch AG, Zug, Switzerland

[22] Filed: Mar. 3, 1975

[21] Appl. No.: 554,438

[30] Foreign Application Priority Data

Mar. 22, 1974 Austria ..... 2418/74

[52] U.S. Cl. ..... 280/631; 280/634

[51] Int. Cl.[2] ..... A63C 9/08

[58] Field of Search ..... 280/11.35 T

[56] References Cited

UNITED STATES PATENTS

| | | | |
|---|---|---|---|
| 3,291,500 | 12/1966 | Voster | 280/11.35 T |
| 3,545,782 | 12/1970 | Salomon | 280/11.35 T |
| 3,649,037 | 3/1972 | Vouthier | 280/11.35 T |
| 3,810,644 | 5/1974 | Beyl | 280/11.35 T |

FOREIGN PATENTS OR APPLICATIONS

| | | | |
|---|---|---|---|
| 288,213 | 2/1971 | Austria | 280/11.35 T |

*Primary Examiner*—Robert R. Song

*Attorney, Agent, or Firm*—Woodhams, Blanchard and Flynn

[57] ABSTRACT

A ski binding having a pivotal boot hold-down part engaging a ski boot sole. The pivotal hold-down part is biased into two separate positions on opposite sides of a dead-center position by a spring. One end of the spring has an operating member located at one end thereof and engages a guideway on the pivotal hold-down part. The housing for holding the spring and the operating member is supported on a pivot axis spaced from the pivot axis for the hold-down part. The position of engagement by the operating member with the guideway effects a defining of a dead-center position relative to the spaced pivot axes.

10 Claims, 5 Drawing Figures

SKI BINDING

FIELD OF THE INVENTION

The invention relates to a ski binding having a pivotal boot hold-down part engaging the boot sole, onto which hold-down part acts at least one spring, which presses the hold-down part, upon exceeding the dead-center position either, on the one side, into the position of use, or, on the other side, into the open or step-in position.

BACKGROUND OF THE INVENTION

Such a ski binding is known from Austrian Pat. No. 288,213. In this ski binding, the spring is on one side hinged to the holding part and on the other side it acts onto a roller, which is guided in a path having stops at its ends. Through this, the danger of the boot getting stuck in the area of the dead-center position is overcome, since the roller slides on a continuous guideway. The known construction has, however, the disadvantage that the use of the roller requires a high exactness in the manufacture and said guideway is thereby sensitive to dirt.

The purpose of the invention is to overcome these disadvantages and to produce a binding, in which a continuous guideway can be used without an associated roller and the dead-center position of the operator member can be exceeded in the opening or the closing direction without getting stuck at the dead-center position.

The set goal is achieved by arranging the guideway on a wall of the hold-down part and the guideway cooperates directly with the front part of an operating member loaded by a spring, which operating member in turn is supported pivotally on the bearing block of the ski binding, whereby the operating member is controlled by a projection.

With the inventive construction, the opening and closing of the ski binding at a predetermined load is carried out simply and safely without the use of additional structural parts. A safe tilting movement is achieved by the control through a projection.

According to a preferred embodiment of the invention, the front part of the operating member has an approximately triangular shape. This permits an advantageous approximation of the pivot axes of hold-down part and operating member.

One characteristic of the invention lies in the front part of the operating member being provided with a rounded-off head. This embodiment contributes to a good travel on the guideway.

According to a further characteristic of the invention, the operating member has in its rearwardly extending area a recess for receiving the loading spring. In this manner further dimensions can be saved.

According to a still further characteristic of the invention, the spring engages at one end a spring plate guided in the operating member, which spring plate can be adjusted in a conventional manner by means of an adjusting screw or the like for regulating the initial stress of the spring, whereby the adjusting screw is supported in a cross wall or the like of the operating member.

According to a different thought of the invention, the operating member is guided in or on a release lever, which for a manual release has a strap or the like.

Through this, a manual release can take place very simply.

According to a still further thought of the invention, the operating member may have a slot, an opening or the like at its upper side for inserting a window indicating the initial stress.

The correct adjustment of the initial stress force can be determined, as usual.

One thought of the invention lies in the guideway being constructed in the rear part of a wall and the loading spring being a pressure spring.

In a further development of the present thought of the invention, the guideway can be constructed on the front part of the wall, whereby the spring is a tension spring. In this construction, the spring force can be utilized even more.

BRIEF DESCRIPTION OF THE DRAWINGS

Further details and advantages of the invention will be disclosed more in detail in connection with the drawings, which illustrate two different embodiments.

In the drawings.

DETAILED DESCRIPTION

Figure 1:
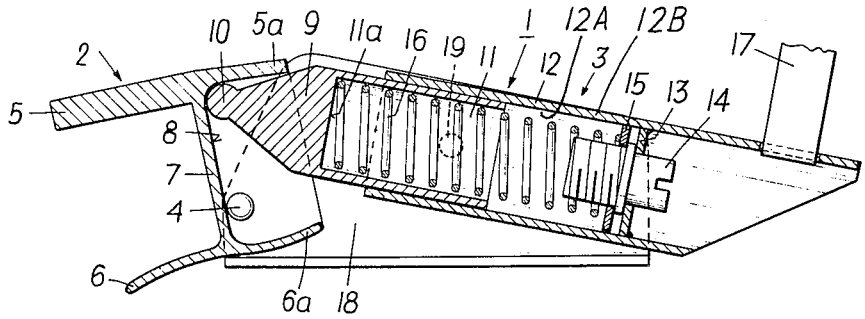
FIGS. 1 to 3 are longitudinal cross-sectional views of a first exemplary embodiment of the inventive ski binding, in three different positions.
Figure 2:
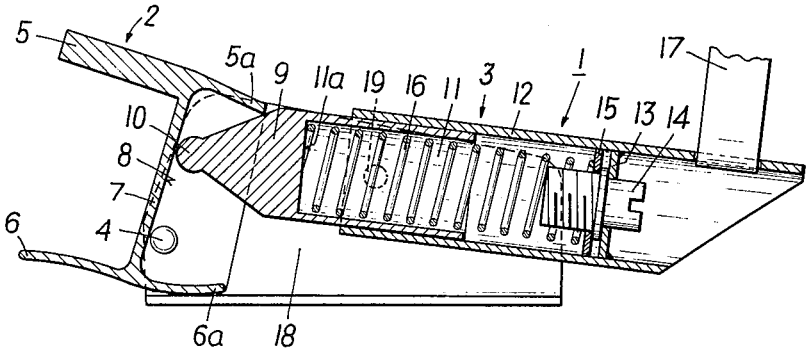
Figure 3:
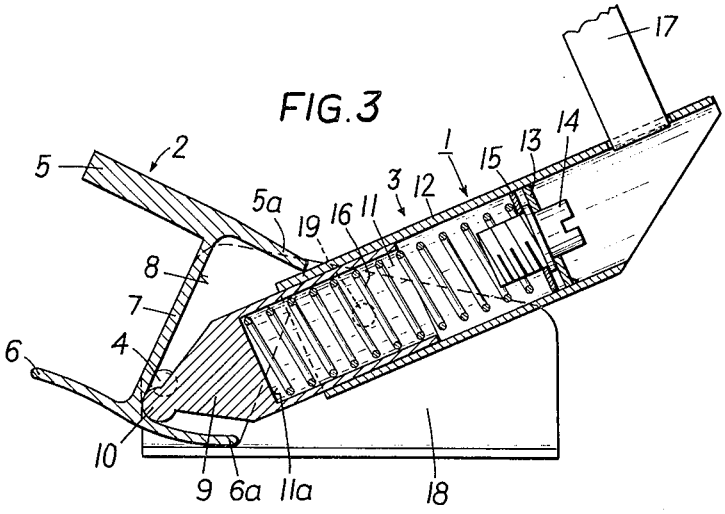

As can be recognized from FIGS. 1 to 3, a ski binding is identified by the reference numeral 1. The ski binding has a boot hold-down or holding part identified by the reference numeral 2 and a release mechanism identified by the reference numeral 3. The holding part 2 is pivotally supported for pivotal movement about a pivot axis 4 and is equipped in a conventional manner with a hold-down flange 5 and a sole bottom engaging flange 6. The hold-down flange 5 and the sole bottom engaging flange 6 are connected by a wall 7 which has a guideway 8 on its back side. The upper end of the wall 7 has a rearwardly extending flange **5*a* at the upper end and a rearwardly extending flange 6*a*** at the lower end.

An operating member 9 of a release mechanism 3 engages the guideway 8. The operating member 9 is constructed, in the illustrated embodiment, in cross section approximately triangularly or wedge-shaped and has at its tip a rounded-off head 10. The wedge-shaped construction of the operating member 9 assures, as illustrated in FIGS. 1 to 3, a better working of the two-sided function. That is, the end 10 of the operating member 9 engages in the position shown in FIG. 1 the wall 7 at the upper end of the guideway 8. According to FIG. 2, the end 10 of the operating member 9 has slid to an intermediate position along the guideway 8. According to FIG. 3, the operating member 9 engages the wall 7 at the lower end of the guideway 8. The operating member 9 has a recess in its rearwardly facing end, preferably a drilled opening 11. The outer surface of the operating member is slidingly received in a guide 12. The guide 12 consists, in the present example, of an opening 12A and a sleeve 12B, which is closed off at the inner end by a fixedly arranged end plate 13. An adjusting screw 14 is positioned in the end plate 13 and is rotatably supported thereon. A spring supporting nut 15 is mounted on the screw 14 and supports one end of a spring 16. The spring 16 is located between the spring supporting nut 15 and the bottom **11*a* of the opening 11 in the operating member 9. A rotation of the adjusting screw 14 will alter the initial tension in the spring 16 to within specified limits. The guide 12 has, for a manual operation of the operating member, a strap 17 or the like secured to the end of the sleeve 12B remote from the operating member 9. The entire release mechanism 3 is pivotally supported about an axis 19 secured on a bearing block 18 which is secured to the ski. More specifically, the sleeve 12B is pivotally secured to the bearing block 18 for movement about the axis 19. The operating member 9 is limited in its movement by the flanges 5***a* and 6*a*.

OPERATION

This ski binding operates as follows:

In the position illustrated in FIG. 1, the not illustrated ski boot is held on the also not illustrated ski by the closed ski binding. If an overload occurs, which stresses the hold-down flange 5, then the entire holding part 2 is forced upwardly, through the operating member 9 against the force of the spring 16. A boundary condition exists at the position of FIG. 2 whereat the spring 16 will urge the holding part 2 counterclockwise about the pivot axis 4 and beyond that position the spring 16 will urge the holding part 2 clockwise about the pivot axis 4. If the dead-center position or the elasticity limit determined by the relative positions of the holding part 2 and the operating member 9 is exceeded, then the release function is accomplished automatically. That is, the operating member 9 exerts thereby a pressure onto the lower area of the guide way 8, which causes the holding part 2 to reach the position illustrated in FIG. 3. The spring 16 is then again relaxed; the initial tension corresponds to the originally adjusted value according to FIG. 1.

Due to the fact that the head 10 of the operating member 9 is rounded-off and has an approximately wedge shape, the pivot axes 4 and 19 can be arranged close to one another.

ALTERNATE CONSTRUCTION

Figure 4:
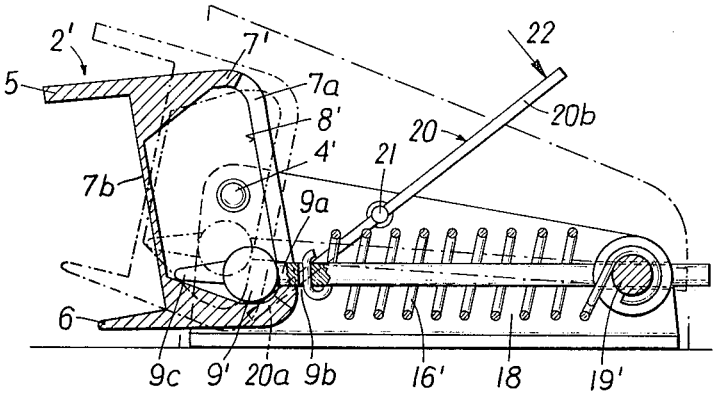
FIGS. 4 and 5 illustrate a second exemplary embodiment of the invention in two positions.
Figure 5:
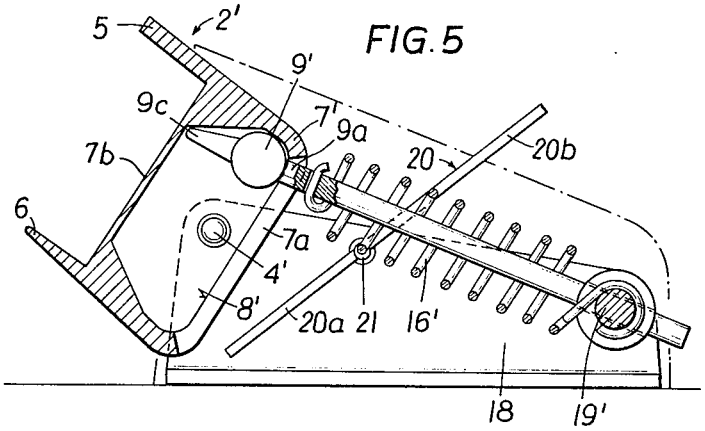

The exemplary embodiment according to FIGS. 4 and 5 differs from what is illustrated in FIGS. 1 to 3 substantially in that a guideway 8' is provided on a frontwardly facing wall 7' on the holding part 2'. The wall 7' cooperates with a spring loaded operating member 9' which is loaded by a tension spring 16'. The holding part 2' is pivotal about a pivot axis 4' arranged in front of the frontwardly facing wall 7' and on the bearing block 18. The tension spring 16' or the operating element is pivotally supported on a pivot axis 19' mounted, like the pivot axis 4', on the bearing block 18. For controlling the movement of the holding part 2', a projection 9*c* slides on a control path on the holding part 2'.

FIG. 4 illustrates the inventive ski binding in closed condition in solid lines and in broken lines at the start of a release condition. FIG. 5 illustrates a complete release condition. The operating zone is closed off in the forward direction by a sealing wall 7*b*.

A two-arm lever 20 is provided for initiating a manual release, which lever is pivotally supported on a pivot axis 21 secured to the bearing block 18 and engages with its frontmost arm 20*a* the operating member 9'. The lever 20 can be loaded by a not illustrated helical spring, which urges it to the illustrated position in FIG. 4. If a manual release is desired, pressure is applied in direction of the arrow 22 in FIG. 4 onto the upper arm 20*b* of the lever 20. Through this action, the force of the tension spring 16' is overcome and the binding is released. After the force has been discontinued, the lever 20 returns to the initial position illustrated in FIG. 5.

The load on the tension spring 16' also occurs during an automatic release. However, in this case, the stress is caused by torque which is created by the pressure exerted onto the holder 5, which pressure is transferred by means of the wall 7 — which acts in relation to the pivot axis 4' as a two-arm lever — onto the operating member 9' and through same onto the tension spring 16'. Here too a certain elasticity exists and until same is reached, the holding part 2' can be loaded without initiating a release function.

The structure of the ski binding according to this exemplary embodiment can be similar to the exemplary embodiment according to FIGS. 1 to 3. To bridge over the wall formed by the wall 7', the wall 7' has in the central zone a vertically elongated opening 7*a* therein. The head of the operating member 9' is guided on one side of the opening 7*a* and penetrates through the opening by a stub 9*a*. The stub 9*a* has a suspension opening 9*b* therein for receiving one end of the tension spring 16'. However, one could proceed so that the central area of the wall 7' is weakened on the two sides and the head of the operating member 9' is held by a type of a fork structure. In this case, one may also use two springs, which are suspended on the two sides of the head part. The advantages of the exemplary embodiment having a guideway arranged on the front side of the wall consists in the possibility of installing a longer spring with the same binding dimensions, which spring has better damping characteristics and which increases the limit of the elasticity.

The invention is not limited to the discussed exemplary embodiments. A number of variations exist which lie within the scope of the claims. For example, the front part of the operating member can be constructed not only triangularly or wedge-shaped, but may have inwardly extending curved surfaces. Also the support of the spring or of the operating member may differ from the specified construction. For example, it is possible to use a pawl, which cooperates with recesses which are constructed, for example, in the form of a rack. Also it is possible to exchange the described release levers with one another.

The rearwardly extending leverlike part of the holder or of the flange acts as a forced guide onto the operating member. These parts assist in a safe release or an easier stepping in. By determining the length of the levers and the construction of the associated guide surface of the operating member, the limit of the elasticity can be determined or controlled. The upper levers forcedly causes the complete opening of the binding. The same action can be achieved by the forwardly extending projection of the second examplary embodiment.

Although particular preferred embodiments of the invention have been disclosed in detail for illustrative purposes, it will be recognized that variations or modification of the disclosed apparatus, including the rearrangement of parts, lie within the scope of the present invention.

The embodiments of the invention in which an exclusive property or privilege is claimed are defined as follows:

1. A ski binding, comprising:

a base member;

a holding part for engaging a boot sole, said holding part having elongated guideway means thereon having first and second spaced limits;

first pivot means for pivotally securing said holding part to said base member, said holding part being pivotal between a position of use and a step-in position;

guide means;

operator means mounted on said guide means and engaging said guideway means and being movable over the length thereof between said first and second limits;

second pivot means for pivotally securing said guide means to said base member; and resilient means engaging and extending between said operator means and said guide means for resiliently holding said operator means at least one of said limits corresponding to one of said position of use and said step-in position, said first and second limits being located on opposite sides of a theoretical straight line connecting said first and second pivot means, said operator means, when aligned with said straight line, being in a dead-center position whereby said resilient means urges said operator means to either one of said first and second limits on opposite sides of said straight line depending on the direction of force applied to said holding part by said ski boot.

2. A ski binding according to claim 1, wherein said operator means includes a front part which has an approximately triangular shape engaging said guideway means at one apex thereof.

3. A ski binding according to claim 1, wherein said operator means includes a front part which has a rounded-off head engaging said guideway means.

4. A ski binding according to claim 1, wherein said guide means has a recess therein for receiving said resilient means therein, said operator means being slidably received in said recess and engaging said resilient means.

5. A ski binding according to claim 1, wherein said resilient means is a spring, wherein said guide means includes a spring plate engaging one end of said spring and adjusting means for adjusting the spacing between said spring plate and said operator means to permit a preadjustment of the tension in said spring.

6. A ski binding according to claim 1, wherein said guide means has a strap fixed thereto to facilitate a manual pivoting of said guide means about said second pivot means and an arbitrary release of said ski binding.

7. A ski binding according to claim 1, wherein said guideway means is constructed on the rear part of a wall of said holding part and said resilient means is a pressure spring.

8. A ski binding according to claim 1, wherein said guideway means is constructed on the front part of a wall of said holding part and said resilient means is a tension spring.

9. A ski binding according to claim 8, wherein said wall has a vertical opening in the central zone thereof, said operator means including a head larger in size than the width of said opening and an elongated stub, said stub being received in said opening, said head engaging said guideway means, one end of said tension spring engaging said stub adjacent said head.

10. A ski binding according to claim 9, wherein said enlarged head engages said wall on both sides of said opening.

* * * * *